US007948443B2

(12) United States Patent
Bullock et al.

(10) Patent No.: US 7,948,443 B2
(45) Date of Patent: May 24, 2011

(54) STRUCTURAL FEED APERTURE FOR SPACE BASED PHASED ARRAY ANTENNAS

(75) Inventors: Steven J. Bullock, Riverside, CA (US); Kenneth H. Griess, Kent, WA (US); Thomas F. Klein, III, Redondo Beach, CA (US); Otis F. Layton, Bonney Lake, WA (US); Julio A. Navarro, Kent, WA (US); Manny S. Urcia, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 372 days.

(21) Appl. No.: 12/018,642

(22) Filed: Jan. 23, 2008

(65) Prior Publication Data

US 2009/0184881 A1 Jul. 23, 2009

(51) Int. Cl.
*H01Q 1/42* (2006.01)

(52) U.S. Cl. ..... 343/789; 343/700 MS; 343/853

(58) Field of Classification Search ..... 343/700 MS, 343/789, 853

See application file for complete search history.

(56) References Cited

U.S. PATENT DOCUMENTS

| | | | | |
|---|---|---|---|---|
| 4,047,181 | A * | 9/1977 | Hoople | 343/789 |
| 4,315,266 | A * | 2/1982 | Frosch et al. | 343/895 |
| 5,191,351 | A * | 3/1993 | Hofer et al. | 343/895 |
| 5,202,697 | A * | 4/1993 | Bonebright et al. | 343/770 |
| 6,225,960 | B1 * | 5/2001 | Collins | 343/786 |
| 7,046,209 | B1 | 5/2006 | McCarville et al. | |

FOREIGN PATENT DOCUMENTS

| | | |
|---|---|---|
| EP | 0570863 | 11/1993 |
| GB | 2247990 | 3/1992 |
| GB | 2299213 | 9/1996 |
| WO | WO 91/20109 | 12/1991 |
| WO | WO 98/47198 | 10/1998 |

OTHER PUBLICATIONS

Application 09250150.1-1248 extended European Search Report.
Olver et al., "Microwave Horns and Feeds," 1994, IEE, United Kingdom, XP002522677 Chapter 9.5.3.

* cited by examiner

*Primary Examiner* — Tho G Phan
(74) *Attorney, Agent, or Firm* — Canady & Lortz LLP; Bradley K. Lortz

(57) ABSTRACT

A structural phased array antenna and method for manufacturing are disclosed. An integrated structural antenna aperture can be used to reduce net weight, cost, and volume where an array of antenna elements are incorporated into a structural member, e.g. in a spacecraft. A structural material layer, such as a structural foam, may be used with the array of individual antenna element cavities machined into the layer. The antenna element cavities are lined with a conductive material, such as plated aluminum. Facesheets may be bonded to the front and/or backside of the structural material layer in order to increase strength and/or stiffness using an RF transparent material. The array of antenna elements may be coupled to filters at the back side of structural material layer.

17 Claims, 10 Drawing Sheets

STRUCTURAL FEED APERTURE FOR SPACE BASED PHASED ARRAY ANTENNAS

BACKGROUND

1. Technical Field

This disclosure relates to antenna system. Particularly, this disclosure relates to phased array antenna systems.

2. Description of the Related Art

An essential component of any wireless communications system is the antenna that transmits and/or receives the electromagnetic signals. One conventional antenna structure, often employed in communications satellites, includes a reflector that has received or transmitted signals "reflected" off it and focused to be collected in one or more feed horns. The reflector and feed horn configuration is typically manipulated to direct or "point" the coverage area of such an antenna. Newer antenna systems may employ phased arrays where an array of discrete antenna elements are used in combination to transmit or receive the desired electromagnetic signal. Such phased array systems can dispense with much of the pointing manipulation typically required with conventional reflectors because the output of the discrete antenna elements of the phased array, through the signal processing, create interference patterns of RF energy that create the desired coverage area and coverage signal strength.

A conventional design approach in developing a phased array antenna (or even a conventional reflector) divides the electrical signal design from the structural design. Thus, the signal design will involve developing the combination of radiating elements, waveguides, and filters in order to achieve the desired coverage and signal strength. Separately, the structural design will be developed to derive the structural configuration for the antenna to support the arrangement of electrical components. This approach can yield results that are less than optimal.

Thus, conventional antenna designs utilize separate structural members to support the antenna. Such conventioanl antenna designs also use individually fabricated feed horns or antenna elements. In conventional antennas, the structural members must be separately fabricated and assembled. This adds extra weight, volume, and fabrication cost. Weight and volume are particularly significant constraints in the design of antenna on spacecraft. For example, lower mass and volume antennas can allow the spacecraft to launch on smaller, less-costly launch vehicles. In addition, the installation of individual horns or antenna elements adds complexity to the dimensional stack up and flow time assembly. Some antenna designs have been developed to alleviate some of these problems.

U.S. Pat. No. 7,046,209, issued May 16, 2006 to McCarville et al. discloses an antenna aperture having electromagnetic radiating elements embedded in structural wall portions of a honeycomb-like core. Independent wall sections each having a plurality electromagnetic radiating elements are formed into the honeycomb-like core. Feed portions of each radiating element form teeth that are copper plated before being assembled onto a back skin panel. Each of the teeth are then generally machined flush with a surface of the back skin to present electrical contact pads which enable electrical coupling to each of the radiating elements by an external antenna electronics board.

However, there is still a need in the art for apparatuses and methods for antenna systems that are structurally efficient, with reduced mass and/or volume. In addition, there is a need for such apparatuses and methods to deliver high performance spacecraft antenna on less expensive launch vehicles.

There is also a need for such apparatuses and methods to provide phased array antenna that are cheaper, lighter and more powerful than convention antenna systems. There is particularly a need for such methods and apparatuses in spacecraft applications. These and other needs are met by the present disclosure as detailed hereafter.

SUMMARY

A structural phased array antenna and method for manufacturing are disclosed. An integrated structural antenna aperture can be used to reduce net weight, cost, and volume where an array of antenna elements are incorporated into a structural member, e.g. in a spacecraft. A structural material layer, such as a structural foam, may be used with an array of individual antenna element cavities machined into the layer. The antenna element cavities are lined with a conductive material, such as plated aluminum. Facesheets may be bonded to the front and/or backside of the structural material layer in order to increase strength using an RF transparent material. The array of antenna elements may be coupled to filters at the back side of structural material layer.

Embodiments of the disclosure allow for less backup structure to support the phased array. In addition, fabrication of the multiple antenna elements in the structural material layer may be machined as a group, rather than individually. This can accelerate overall production of the antenna.

Embodiments of the disclosure can provide large cost savings over the existing antenna solutions by reducing the overall mass and volume of a spacecraft. This can allow the spacecraft to be launched on a smaller, less-costly launch vehicles. Thus, the overall savings can be significant. Embodiments of the disclosure can enable the design, manufacturing, and testing of phased array antennas, particularly space-based antenna, that are cheaper, lighter, and more powerful than current antennas.

A typical embodiment of the disclosure comprises a phased array antenna including a supporting material layer having an array of antenna element cavities, each antenna element cavity of the array of antenna element cavities having an aperture open to a front side of the supporting material layer and an interface open to a back side of the supporting material layer, and a conductive layer lining each antenna element cavity of the array of antenna element cavities. The supporting material layer may comprise a structural foam, such as polymethacrylimide. In some embodiments of the disclosure, the conductive layer may comprise plated aluminum.

The phased array antenna may be employed such that the supporting material layer comprises a support in an underlying structure for the phased array antenna. In one example, the support in the underlying structure for the phased array antenna may be disposed on a spacecraft. The structural efficiency of the phased array yields a lower overall mass, an important consideration in spacecraft design.

In further embodiments of the disclosure, one or more facesheets may be affixed to at least one of the front side and the back side of the supporting material layer to provide additional structural support. Typically, the one or more facesheets comprise a substantially RF transparent material.

In some embodiments of the disclosure, the phased array antenna may also include an array of antenna element filters, each filter of the array of antenna element filters coupled to the interface of each antenna element cavity of the array of antenna element cavities.

In a similar manner, a typical method of manufacturing a phased array antenna comprises the steps of machining an array of antenna element cavities in a supporting material layer, each antenna element cavity of the array of antenna element cavities having an aperture open to a front side of the supporting material layer and an interface open to a back side of the supporting material layer, and lining each antenna element cavity of the array of antenna element cavities with a conductive layer lining. In some embodiments of the disclosure, lining each antenna element cavity of the array of antenna element cavities of the array with the conductive layer lining comprises plating the conductive layer onto a mandrel matching each antenna element cavity, bonding the conductive layer into each antenna element cavity using the mandrel, and removing the mandrel leaving the conductive layer bonded into each antenna element cavity. Method embodiments of the disclosure may be further modified consistent with the apparatus and system embodiments described herein.

In addition, a phased array antenna embodiment may include a material layer means for supporting a structure, the material layer having an array of antenna element cavities, each antenna element cavity of the array of antenna element cavities having an aperture open to a front side of the material layer and an interface open to a back side of the material layer, and a conductive layer lining each antenna element cavity of the array of antenna element cavities. The apparatus embodiments of the disclosure may be further modified consistent with the method and system embodiments described herein.

BRIEF DESCRIPTION OF THE DRAWINGS

Referring now to the drawings in which like reference numbers represent corresponding parts throughout.

DETAILED DESCRIPTION OF THE PREFERRED EMBODIMENT

1. Overview

As previously mentioned, embodiments of the disclosure are directed to structural phased array antennas and methods for their manufacturing. An array of antenna elements can be incorporated into a structural member of a spacecraft where a structural material layer, such as a structural foam, has an array of individual antenna element cavities machined into the layer. The antenna element cavities are lined with a conductive material, such as plated aluminum. Facesheets may also be bonded to the front and/or backside of the structural material layer in order to increase strength and/or stiffness using an RF transparent material. The array of antenna elements may be coupled to filters at the back side of structural material layer that lead to the remainder of the communications signal electronics.

Embodiments of the disclosure allow for less backup structure to support the phased array, thus reducing the weight, cost, and volume. Embodiments of the disclosure afford a unique integrated solution for the aperture antenna elements (feed horns) and structure. This can yield a net lower cost and weight. Additional benefit can be derived from the ability to fabricate the aperture antenna elements together rather than individually as with conventional antennas. Thus, the multiple antenna elements in the structural material layer may be machined as a group, rather than individually produced in the traditional manner. This can further accelerate overall production of the antenna.

Embodiments of the disclosure can provide a significant cost savings over the existing antenna solutions by reducing the overall mass and volume of a spacecraft. This can allow the spacecraft to be launched on smaller, less-costly launch vehicles. Thus, the overall savings can be significant. Embodiments of the disclosure can enable the design, manufacturing, and testing of phased array antennas, particularly space-based antenna, that are cheaper, lighter, and more powerful than current antennas.

2. Structural Phased Array Antenna

Figure 1A:
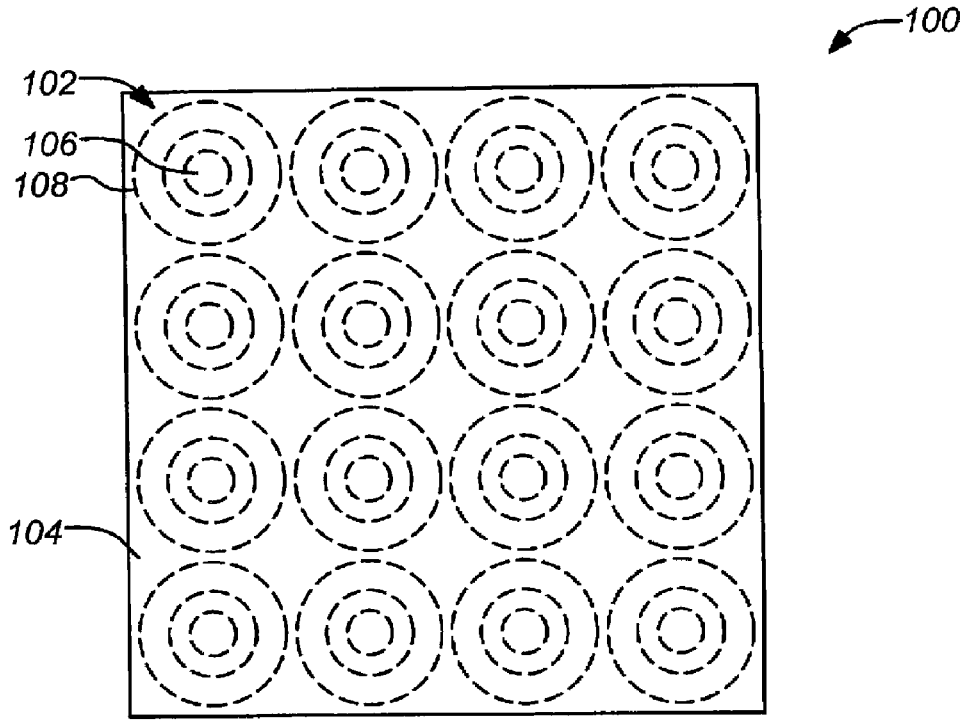
FIGS. 1A & 1B illustrate top and side views of an exemplary configuration of a structural phased array antenna in accordance with the disclosure.
Figure 1B:
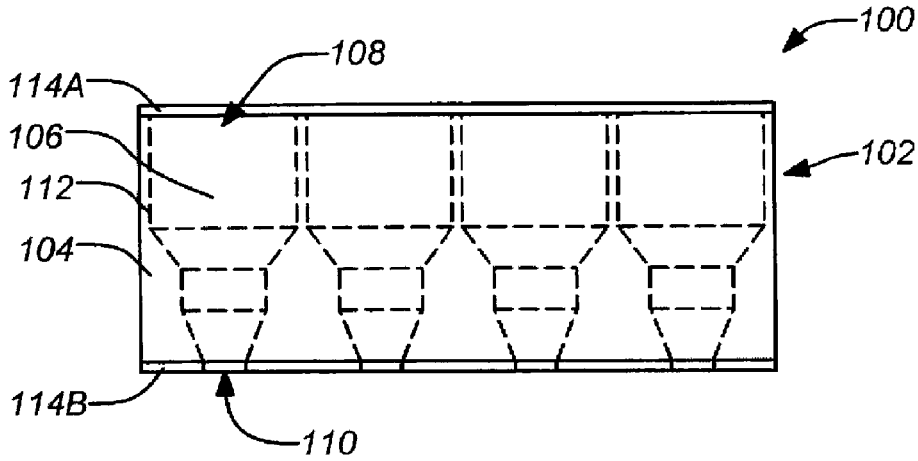

FIGS. 1A & 1B illustrate top and side views of an exemplary configuration of a structural phased array antenna 100 in accordance with the disclosure. The antenna 100 comprises an array of antenna elements 102 (or feed horns) integrated directly into a supporting material layer 104. Each antenna element is formed from a cavity 106 machined into the supporting material layer 104 having an aperture 108 open to a front side of the supporting material layer 104 and an interface 110 open to a back side of the supporting material layer 104. In addition, the cavity 106 of each of the array of antenna elements 102 is lined with a conductive layer 112 lining in order to provide the proper electrical properties to function as a radiating element in the phased array antenna 100.

Finally, one or more facesheets 114A, 114B may be affixed to one or both of the front and back side of the supporting material layer 104 in order provide additional structural support. The facesheets 114A, 114B should be constructed from an RF transparent material so they do not interfere with the function of the antenna elements 102 in the operating antenna 100. The facesheets are optional, but may be highly desirable in most applications. In use the interface 110 of each antenna element 102 will be coupled to the antenna electronics (e.g. a waveguide or filter). This may be accomplished through a bolted interface (using metal or non-metallic bolts) or possibly by bonding. Accordingly, any facesheet 114B on the back side of the supporting material layer 104 should have cutouts that minimally allow connection to the conductive layer 112 at the interface 110 of each antenna element 102. In addition, to achieve acceptable passive intermodulation (PIM) characteristics, no metal (conductive) materials should be employed for components (e.g., the front side facesheet 114A) disposed above the aperture plane of the antenna elements, i.e., the plane at the front side of the supporting material layer 104.

Various materials may be used in the construction of the structural phased array antenna 100. For space applications, material properties should meet higher standards than terrestrial applications. For example, materials must exhibit limited outgassing (e.g., <1% total mass loss and <0.1% volatile condensable material). Similarly, the materials should be qualified for a wide temperature range (e.g., −15° C. to +120° C.) for space applications. The supporting material layer 104 should be a non-conductive material to eliminate interference with operation of the antenna elements 102. (Conductive materials may be used for the supporting material layer 104, but this will require isolation from the antenna elements, complicating the detailed design.) Structural foams, such as polymethacrylimide, are well suited for use as the supporting material layer 104. The material of the supporting material layer 104 may comprise a homogenous layer (e.g. such as with a structural foam) or a heterogenous layer (e.g., utilizing a combination of materials). The conductive layer 112 lining each of the antenna elements 102 may be a plated metal, such as aluminum, copper, nickel, or gold. Thus, the conductive layer 112 may be extremely thin, e.g. on the order of 1 mil thickness. The minimal thickness coupled with aluminum lining produces a very light weight configuration. The facesheets 114A, 114B may be constructed using Cyanate-Ester Astro-Quartz or fiberglass. Both front and back facesheets can employ similar coefficient of thermal expansion properties to reduce warping of the antenna.

Although most phased array antennas are developed using identical antenna elements, it should be noted that the size and separation of the antenna elements 104 are determined from the combination of structural requirements (strength, stiffness, etc.) and electrical requirements (frequency, power, pointing range, etc.) in the overall design of the antenna 100, as will be understood by those skilled in the art. It should also be noted that although the antenna elements 102 are shown as being identical, this is not required; varying sizes of individual antenna elements and sub-arrays of elements may be employed in accordance with the principles described herein as will be understood by those skilled in the art. In addition, although the exemplary structural phased array antenna 100 is described as a receive antenna, embodiments of the disclosure are not limited to receive antennas. The principles described herein are also directly applicable to transmit antenna, as will be understood by those skilled in the art.

Figure 1C:
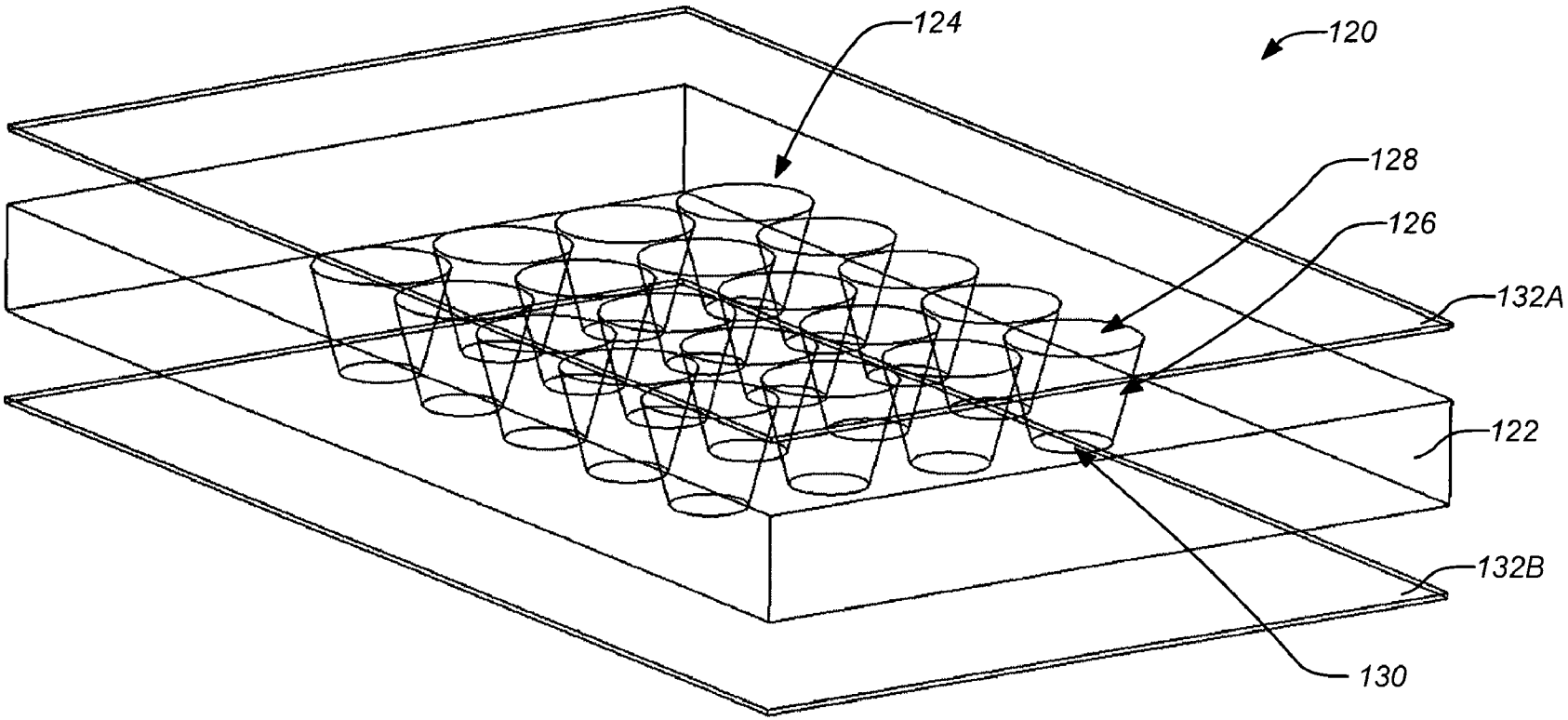
FIG. 1C illustrates an isometric view of an exemplary configuration of a structural phased array antenna in accordance with the disclosure.

FIG. 1C illustrates an isometric schematic view of an exemplary configuration of a structural phased array antenna 120 in accordance with the disclosure. The supporting material layer 122 is shown with the array of antenna element cavities within the layer 122. The array of antenna elements 124 each comprise a cavity 126 having an aperture 128 open to a front side of the supporting material layer 122 and an interface 130 open to a back side of the supporting material layer 122. Note that the shape of the antenna element cavity 126 in FIG. 1C is simplified compared with the cavity 106 of the antenna 100 of FIGS. 1A & 1B. The specific shape of the cavity will depend upon the desired electrical performance (e.g. frequency range, etc.) for the particular antenna as will be understood by those skilled in the art. Finally, the antenna 120 may incorporate one or more facesheets 132A, 132B that may be bonded to the front and/or back side of the supporting material layer 122 to add strength and/or stiffness. (Facesheets 132A, 132B are shown separated from the supporting material layer 122 in FIG. 1C for clarity.) Various detailed steps of an example manufacturing process further illustrate an example structural phased array antenna as described hereafter.

Figure 2A:
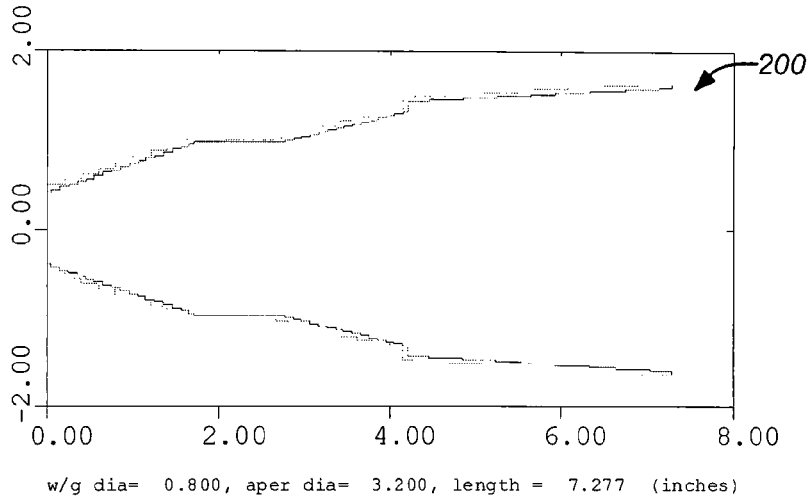
FIGS. 2A to 2E illustrate an example structural phased array antenna from the steps in an exemplary process of manufacturing the structural phased array antenna in accordance with the disclosure.

FIGS. 2A to 2E illustrate an example structural phased array antenna from the steps in an exemplary process of manufacturing the structural phased array antenna in accordance with the disclosure. FIG. 2A illustrates a profile 200 of an example antenna element that may be employed in an embodiment of the disclosure. This antenna element comprises a transmit radiating element operating in the Ku frequency band. It should be noted that other antenna element profiles may be similarly developed for radiating elements operating in other frequency bands and for receive antennas as will be understood by those skilled in the art.

Figure 2B:
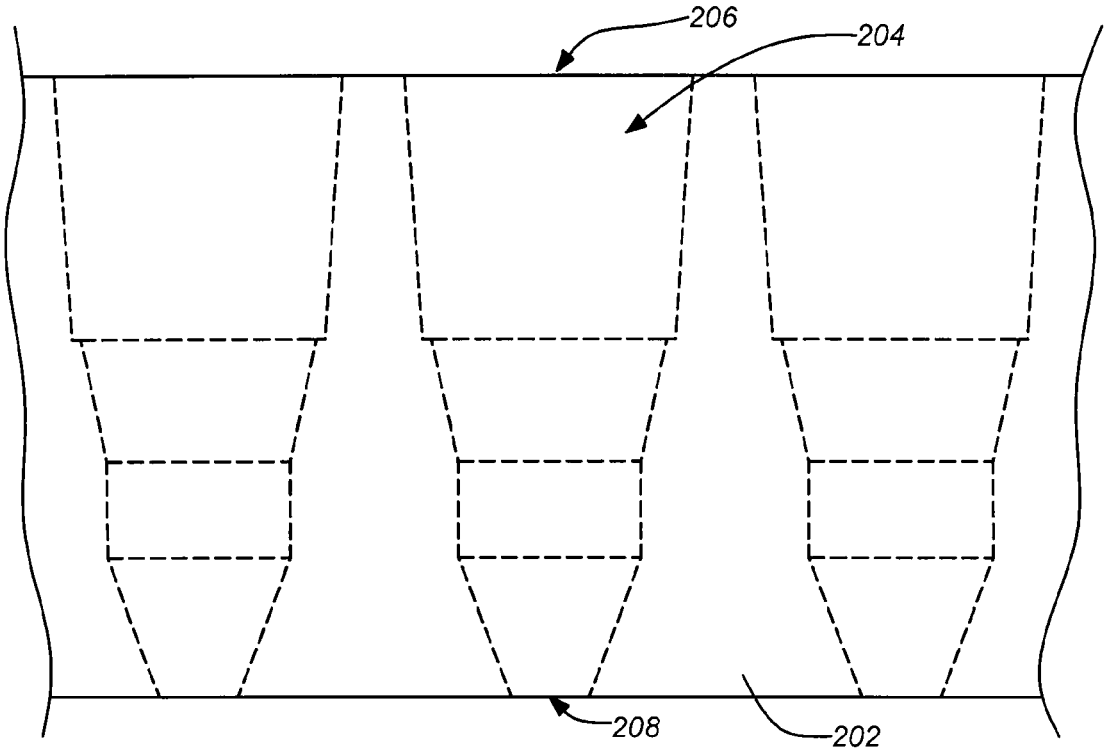

FIG. 2B illustrates an array of antenna element cavities 204 matching the profile 200 are machined through a structural material layer 202, e.g. such as a structural foam. Each antenna element cavity 204 through the structural material layer 202 has an aperture 206 open to the front side of the layer 202 and an interface 208 open to the back side of the layer 202.

The structural material layer may be made from a structural foam known as ROHACELL® HF, manufactured by Degussa, that is used in antennas, radomes and X-ray tables. This is a polymethacrylimide (PMI) closed-cell rigid foam plastic that does not contain any chlorofluorocarbons (CFCs). The structural foam has a density of approximately 2.0 lb/ft$^3$, a compressive strength of approximately 58 psi, a tensile strength of approximately 145 psi, and meets outgassing requirements described above. In addition, the foam has a survival temperature in excess of 160° C.

Figure 2C:
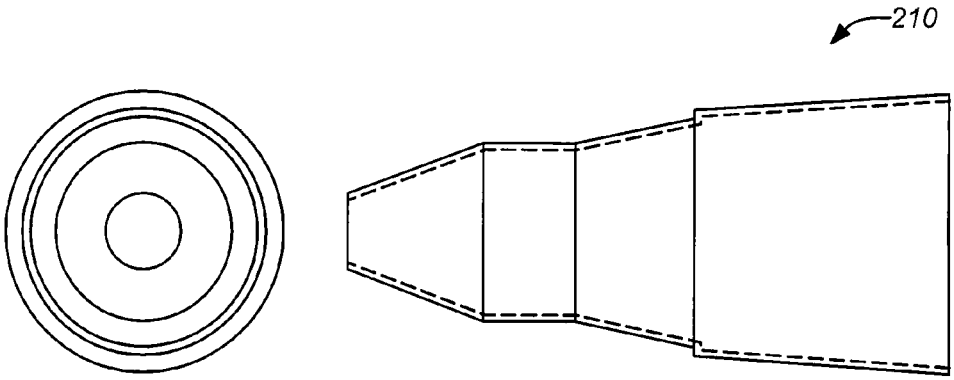

FIG. 2C shows a solid mandrel 210 is cut that also matches the profile 200 of the antenna element to be used in the manufacturing process. The mandrel 210 is fabricated to define the interior shape and surface roughness of antenna element. For example, the mandrel surface roughness may be 64 rms which will be transferred to the antenna element through later processing described hereafter. The mandrel 210 may be used to develop the conductive material of the antenna element in the phased array by plating the mandrel surface with a thin metal layer 212 shown in FIG. 2D, such as aluminum. For example, 1 mil of pure aluminum may be electroformed onto the mandrel 210. The mandrel 210 surface may be treated with an agent to facilitate separation of the metal layer 212 in the following processing. Additionally, a dissolvable mandrel, such as Aquapour by Advanced Ceramics Manufacturing, may be plated and dissolved after insertion into the cavity to produce the conductive lining.

Figure 2D:
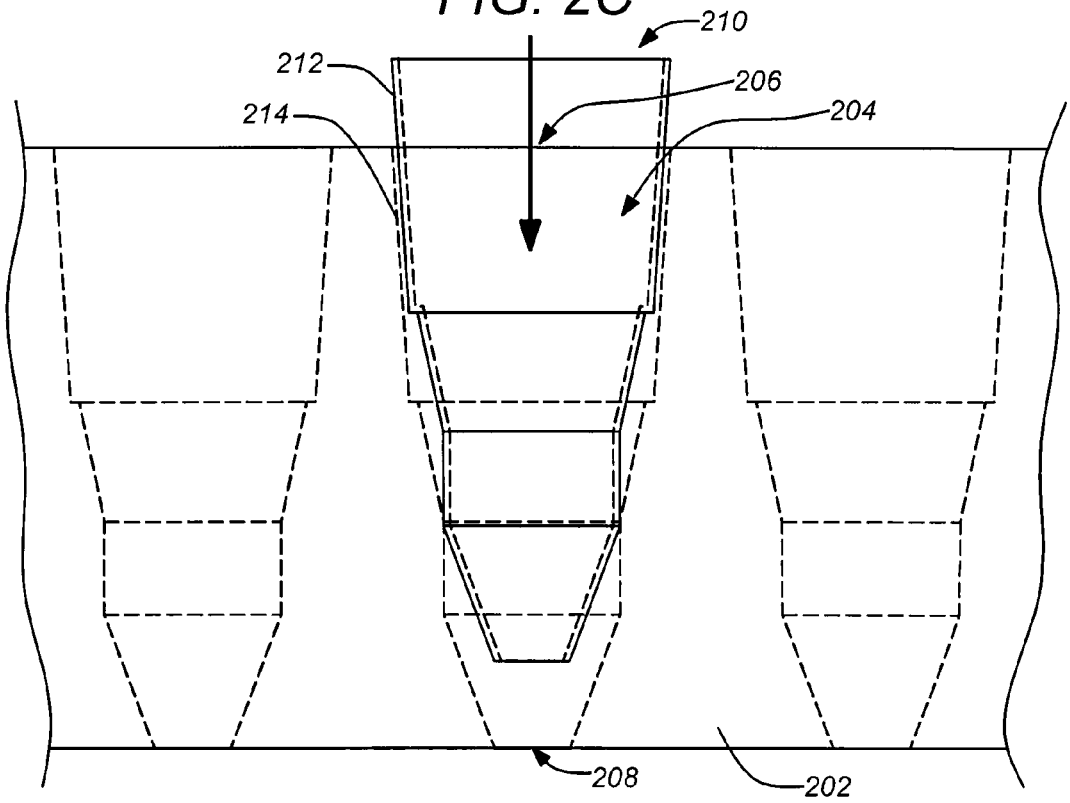

FIG. 2D illustrates application of the metal layer 212 to the antenna element cavity 204. An adhesive, such as Hysol EA9394, is applied to the surface 214 of the antenna element cavity 204. The mandrel 210 with the metal layer 212 is then inserted into the antenna element cavity 204 as shown. Accordingly, the metal layer 212 becomes bonded to the surface 214 of the antenna element cavity 204.

Figure 2E:
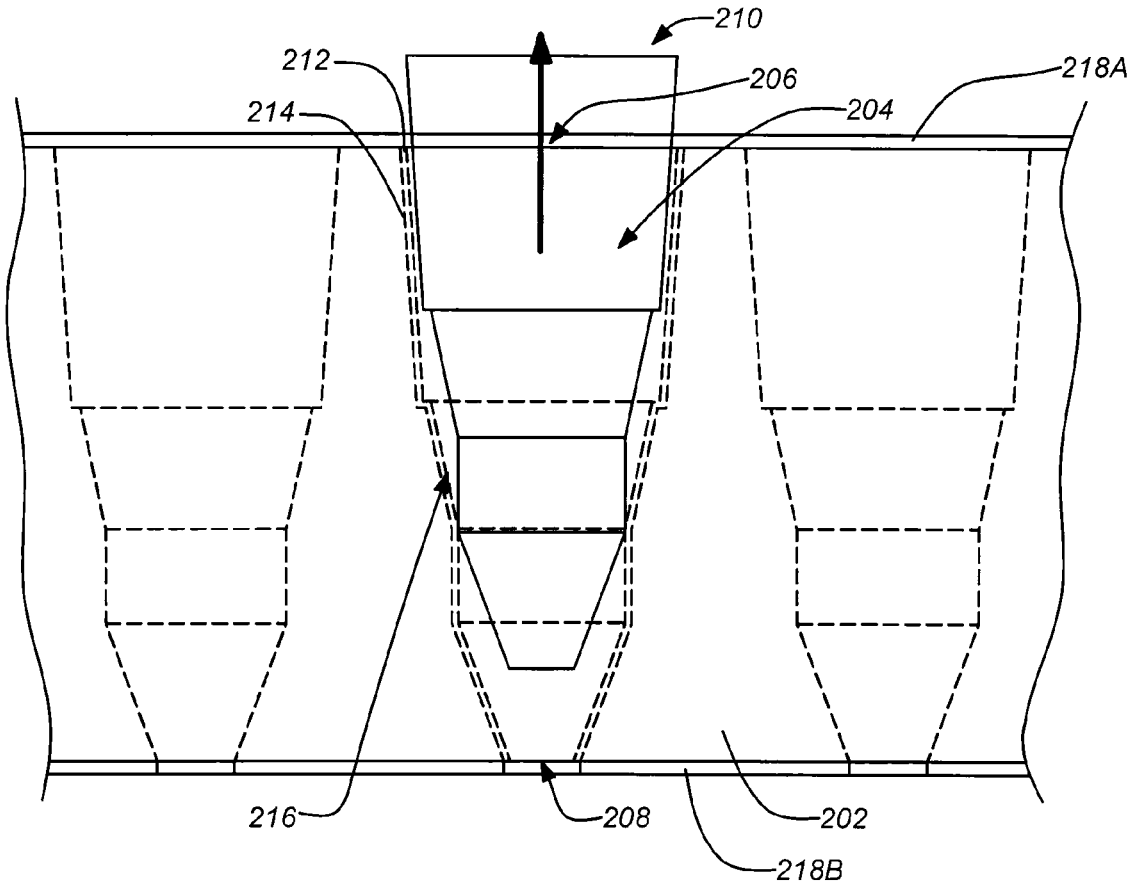

FIG. 2E illustrates removal of the mandrel 210 leaving a cavity 204 with a metal layer 212 lining to form the antenna element 216. The transferred aluminum provides the inner surface lining of the antenna element. The resultant inner lining produces a matched surface roughness of the mandrel. This is repeated for each cavity to produce the complete phased array antenna. A batch process may also be employed which utilizes a block of mandrels which are all inserted and removed simultaneously. Following this facesheets 218A, 218B, e.g., of Cyanate-Ester Astro-Quartz, may be bonded, using a structural adhesive film such as 3M AF-126 structural adhesive film, to the front and/or back surfaces of the structural material layer 202 to improve strength.

Figure 3A:
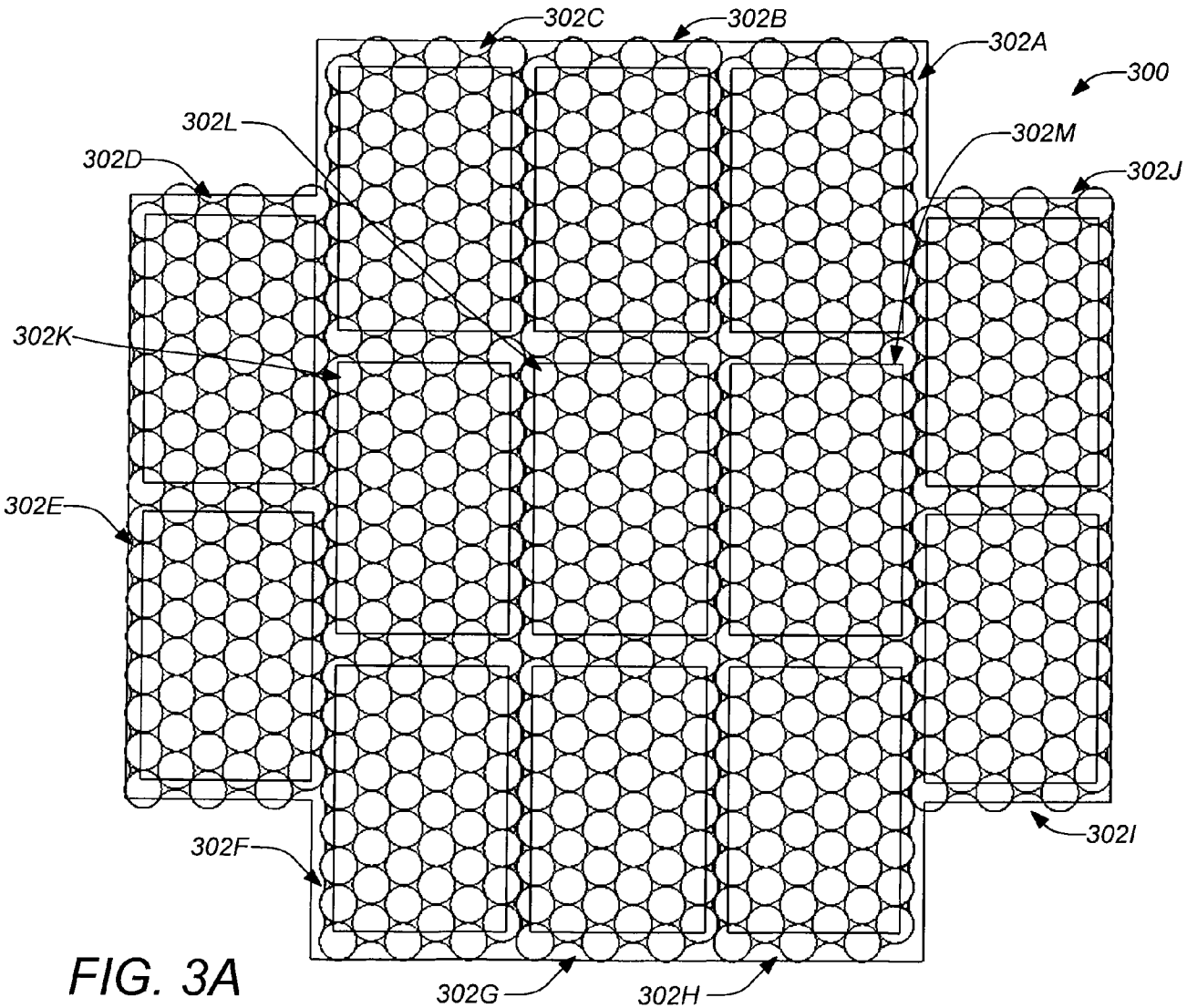
FIGS. 3A and 3B illustrate top view and side view line drawings of an example structural phased array antenna in accordance with the disclosure.
Figure 3B:
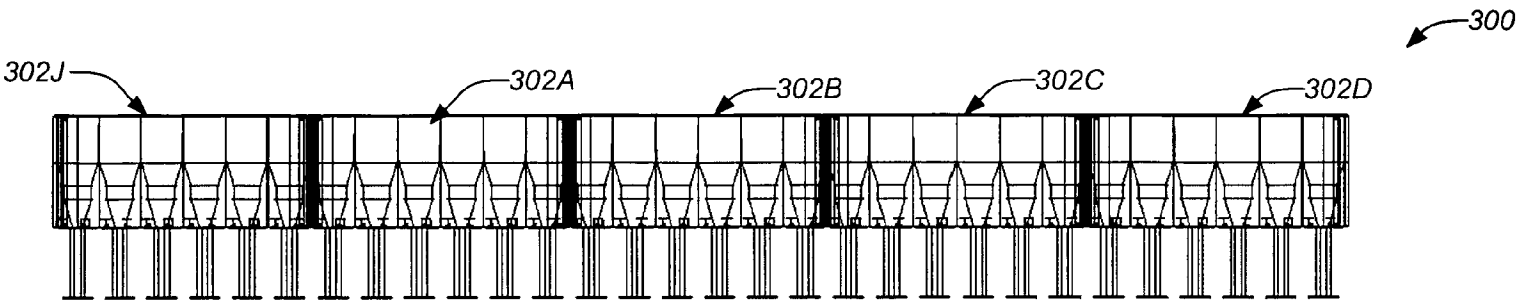

FIGS. 3A and 3B illustrate top view and side view line drawings of an example structural phased array antenna 300 in accordance with the disclosure. The phased array antenna 300 is shown as a combination of thirteen sub-arrays 302A-302M. Each sub-array includes a separate front facesheet bonded to the front surface of its respective structural material layer. Each sub-array 302A-302M may be separately constructed as previously described and then integrated into the full antenna 300 assembly.

Figure 3C:
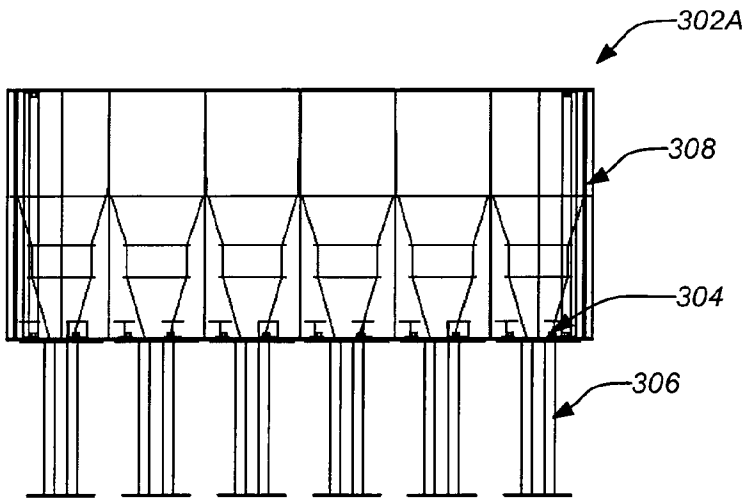
FIGS. 3C and 3D illustrate side view and isometric view line drawings of the example subarray of the structural phased array antenna.
Figure 3D:
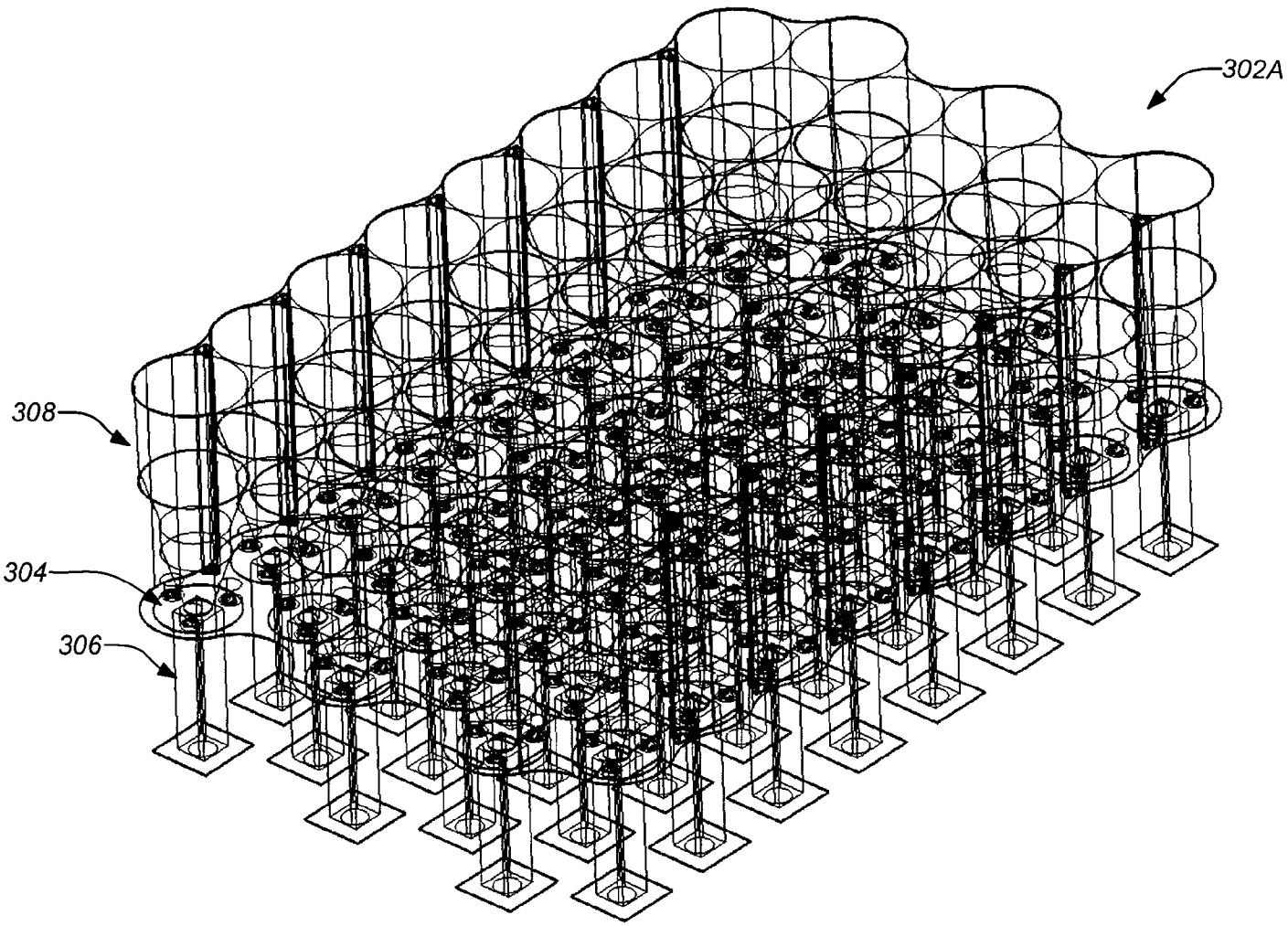

FIGS. 3C and 3D illustrate side view and isometric view line drawings of the example subarray 302A of the structural phased array antenna 300. Each subarray may be attached to adjacent subarrays through the use of bonded straps that produce a lap joint on each facesheet. The interface 304 of each antenna element 308 is coupled to a separate waveguide filter 306 through a nutplate interface 304 as shown. The nutplate interface 304 uses a pattern of bolts which bolt the filters to the lower skin at their respective waveguide interface. This allows for coupling the waveguide filter 306 to the interface 304 of the antenna element 308 (i.e., the conductive lining at the interface at the back side of the structural material layer). A bonded interface may also be used which could comprise of a conductive lining on the lower portion of the cavity to match up to the top of filter interface and provide an interconnect.

Figure 4:
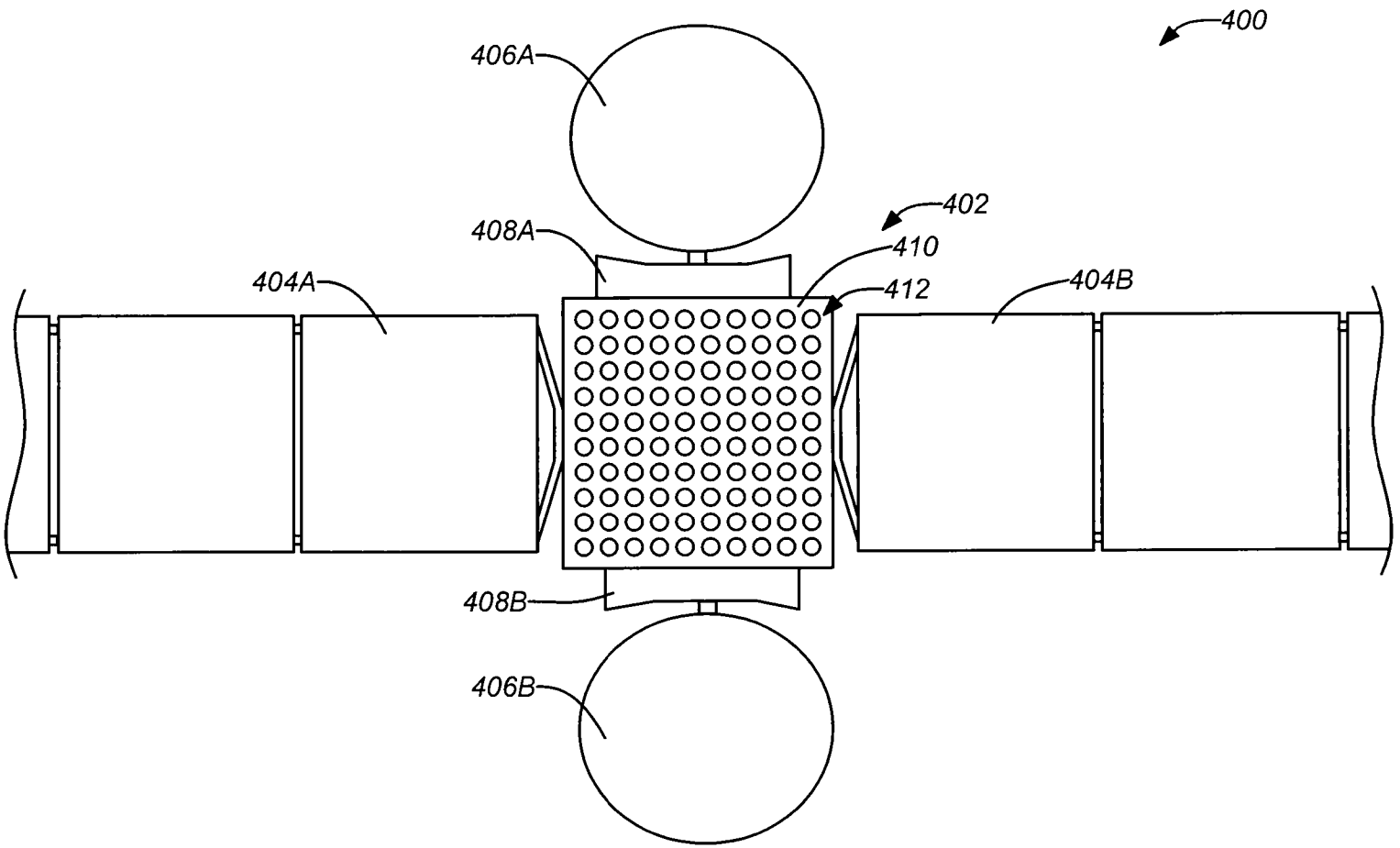
FIG. 4 illustrates an exemplary satellite that may employ a structural phased array antenna.

FIG. 4 illustrates an exemplary satellite 400 that may employ a structural phased array antenna. The exemplary satellite 400 is a body-stabilized spacecraft that orbits the Earth and is used to provide communications between different locations on the Earth (and/or different spacecraft). The satellite 400 comprises a central bus structure 402 from which solar arrays 404A, 404B extend to capture and convert solar energy to electrical energy to power the various systems of the satellite 400. In addition, the satellite 400 includes a pair of conventional reflector antennas 406A, 406B that receive and transmit signals from feed horns 408A, 408B, respectively.

The satellite 400 is only an example; those skilled in the art will appreciate embodiments of the disclosure may be applied to any spacecraft. In addition, it should be noted that structural phased array antennas in accordance with the disclosure are not limited to satellite applications, but may be employed with any other type of spacecraft or even terrestrial applications. However, the structural efficiency afforded by embodiments of the disclosure make them particularly useful in satellites because limited mass and volume are always critical constraints in any space-borne system.

As shown above, a phased array antenna in accordance with the disclosure is integrated into a supporting framework. Conventional antennas typically use parasitic weight to provide the backbone of the supporting structure. Embodiments of the disclosure, on the other hand, can reduce the parasitic weight because they provide an integrated structural, load-bearing member. Thus, embodiments of the disclosure enable net cost, weight, and volume savings while still providing equal RF performance of existing antenna solutions.

Embodiments of the disclosure surpass existing solutions because they allow the antenna to be a self-supporting structure. This can reduce or eliminate any parasitic weight as compared with the structural members of existing solutions. This can also improve the installation time and the required envelope due dimensional stack up associated with installing individual feed horns in a conventional antenna.

3. Method of Manufacturing a Structural Phased Array Antenna

Embodiments of the disclosure also encompass a method of manufacturing a structural phased array antenna consistent with the foregoing apparatus and process descriptions.

Figure 5A:
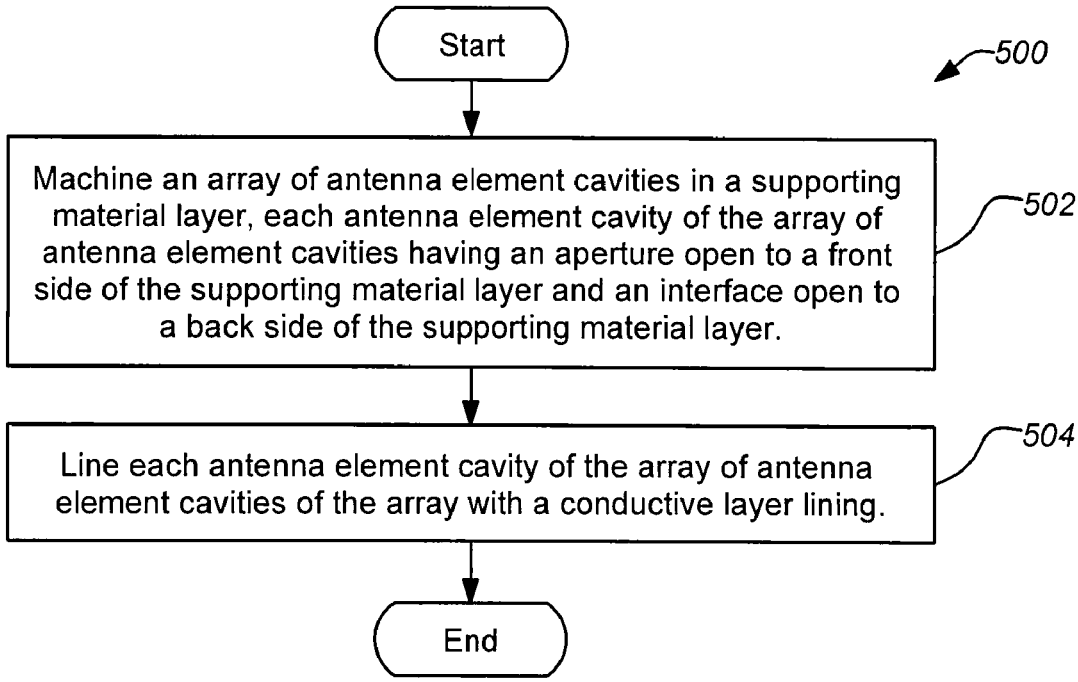
FIG. 5A is a flowchart of an exemplary method of manufacturing a structural phased array antenna in accordance with the disclosure.

FIG. 5A is a flowchart of an exemplary method 500 of manufacturing a phased array antenna in accordance with the disclosure. In a first operation 502, an array of antenna element cavities are machined in a supporting material layer, each antenna element cavity of the array of antenna element cavities having an aperture open to a front side of the supporting material layer and an interface open to a back side of the supporting material layer. The appropriate machining process will depend upon the selected supporting material layer. Structural foams may be readily machined on an NC mill, for example. Next, each antenna element cavity of the array of antenna element cavities is lined with a conductive layer in operation 504. Lining the cavities with a conductive layer may be performed by bonding in a conductive layer, e.g., a metal, or possibly plating the cavity directly.

Figure 5B:
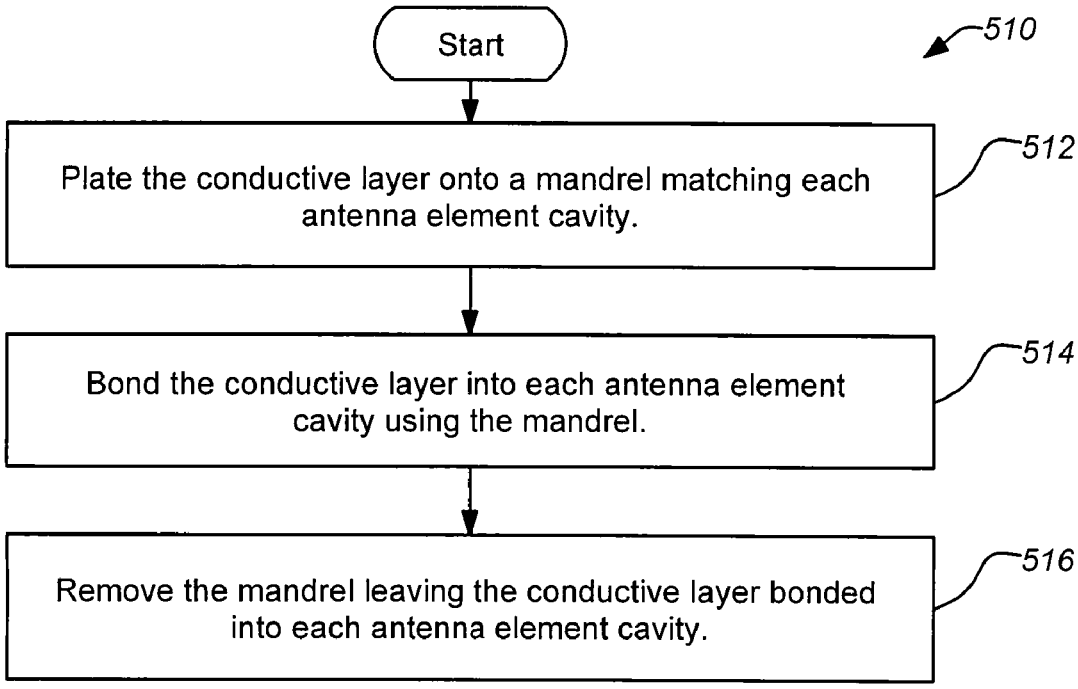
FIG. 5B is a flowchart of an exemplary sub-method for lining the antenna element cavities with a conductive material as part of manufacturing a structural phased array antenna.

FIG. 5B is a flowchart of an exemplary sub-method 510 for lining the antenna element cavities with a conductive material as part of manufacturing a phased array antenna, i.e., operation 504 of method 500 in FIG. 5A. The sub-method 510 begins with an operation 512 of plating the conductive layer onto a mandrel matching each antenna element cavity. Next in operation 512, the conductive layer is bonded into each antenna element cavity using the mandrel. Finally in operation 514, the mandrel removed, leaving the conductive layer bonded into each antenna element cavity. The method 500 and sub-method 510 may be further modified consistent with the apparatuses and systems described herein.

In addition to the integrated structural phased array, embodiments of the disclosure also provide for ease of installation with the collective fabrication of a "sub-array". In an effort to further reduce weight and assembly time, embodiments of the disclosure may also include the fabrication of a "sub-array" of antenna elements (which are then integrated into a larger array), as opposed to the fabrication and installation of individual horns as with conventional antennas.

This concludes the description including the preferred embodiments of the present disclosure. The foregoing description including the preferred embodiment of the disclosure has been presented for the purposes of illustration and description. It is not intended to be exhaustive or to limit embodiments of the disclosure to the precise forms disclosed. Many modifications and variations are possible within the scope of the foregoing teachings. Additional variations of the present embodiments of the disclosure may be devised without departing from the inventive concept as set forth in the following claims.

What is claimed is:

1. A phased array antenna, comprising:

a supporting material layer having an array of antenna element cavities, each antenna element cavity of the array of antenna element cavities having an aperture open to a front side of the supporting material layer and an interface open to a back side of the supporting material layer;

a conductive layer lining each antenna element cavity of the array of antenna element cavities, the conductive layer lining formed by plating the conductive layer onto a mandrel matching each antenna element cavity, bonding the conductive layer into each antenna element cavity using the mandrel, and removing the mandrel leaving the conductive layer bonded into each antenna element cavity;

a front side structural support facesheet affixed to the front side of the supporting material layer; and a back side structural support facesheet affixed to the back side of the supporting material layer;

wherein the front side structural support facesheet comprises a non-conductive material.

2. The phased array antenna of claim 1, wherein the supporting material layer comprises a structural foam.

3. The phased array antenna of claim 2, wherein the structural foam comprises polymethacrylimide.

4. The phased array antenna of claim 1, wherein the supporting material layer comprises a support in an underlying structure for the phased array antenna.

5. The phased array antenna of claim 4, wherein the support in the underlying structure for the phased array antenna is disposed on a spacecraft.

6. The phased array antenna of claim 1, wherein the front side structural support facesheet and the backside structural support facesheet comprise a substantially RF transparent material.

7. The phased array antenna of claim 1, wherein the conductive layer comprises plated aluminum.

8. The phased array antenna of claim 1, further comprising an array of antenna element filters, each filter of the array of antenna element filters coupled to the interface of each antenna element cavity of the array of antenna element cavities.

9. A method of manufacturing a phased array antenna, comprising the steps of:

machining an array of antenna element cavities in a supporting material layer, each antenna element cavity of the array of antenna element cavities having an aperture open to a front side of the supporting material layer and an interface open to a back side of the supporting material layer;

lining each antenna element cavity of the array of antenna element cavities with a conductive layer lining by plating the conductive layer onto a mandrel matching each antenna element cavity, bonding the conductive layer into each antenna element cavity using the mandrel, and removing the mandrel leaving the conductive layer bonded into each antenna element cavity;

affixing a front side structural support facesheet to the front side of the supporting material layer; and affixing a back side structural support facesheet to the back side of the supporting material layer;

wherein the front side structural support facesheet comprises a non-conductive material.

10. The method of claim 9, wherein the supporting material layer comprises a structural foam.

11. The method of claim 10, wherein the structural foam comprises polymethacrylimide.

12. The method of claim 9, wherein the supporting material layer comprises a support in an underlying structure for the phased array antenna.

13. The method of claim 12, wherein the support in the underlying structure for the phased array antenna is disposed on a spacecraft.

14. The method of claim 9, wherein the front side structural support facesheet and the backside structural support facesheet comprise a substantially RF transparent material.

15. The method of claim 9, wherein the conductive layer comprises aluminum.

16. The method of claim 9, further comprising coupling each filter of an array of antenna element filters to the interface of each antenna element cavity of the array of antenna element cavities.

17. A phased array antenna, comprising:

a material layer means for supporting a structure, the material layer having an array of antenna element cavities, each antenna element cavity of the array of antenna element cavities having an aperture open to a front side of the material layer and an interface open to a back side of the material layer;

a conductive layer lining each antenna element cavity of the array of antenna element cavities, the conductive layer lining formed by plating the conductive layer onto a mandrel matching each antenna element cavity, bonding the conductive layer into each antenna element cavity using the mandrel and removing the mandrel leaving the conductive layer bonded into each antenna element cavity;

a front side structural support facesheet means for additional structural support affixed to the front side of the supporting material layer; and a back side structural support facesheet means for additional structural support affixed to the back side of the supporting material layer;

wherein the front side structural support facesheet means comprises a non-conductive material.

* * * * *